US010961765B2

(12) United States Patent
Kinoshita et al.

(10) Patent No.: US 10,961,765 B2
(45) Date of Patent: Mar. 30, 2021

(54) WINDOW REGULATOR

(71) Applicant: SHIROKI CORPORATION, Fujisawa (JP)

(72) Inventors: Kimihiro Kinoshita, Fujisawa (JP); Natsuki Ito, Fujisawa (JP)

(73) Assignee: SHIROKI CORPORATION, Fujisawa (JP)

( * ) Notice: Subject to any disclaimer, the term of this patent is extended or adjusted under 35 U.S.C. 154(b) by 93 days.

(21) Appl. No.: 16/177,640

(22) Filed: Nov. 1, 2018

(65) Prior Publication Data

US 2019/0136599 A1 May 9, 2019

(30) Foreign Application Priority Data

Nov. 6, 2017 (JP) ..... JP2017-213704

(51) Int. Cl.
*E05F 11/48* (2006.01)
*E05F 11/38* (2006.01)
*E05F 15/689* (2015.01)

(52) U.S. Cl.
CPC ..... *E05F 11/488* (2013.01); *E05F 11/382* (2013.01); *E05F 11/483* (2013.01); *E05F 15/689* (2015.01); *E05Y 2201/658* (2013.01); *E05Y 2600/53* (2013.01); *E05Y 2900/55* (2013.01)

(58) Field of Classification Search
CPC ..... E05F 11/483; E05F 11/488; E05F 11/382; E05F 15/689
See application file for complete search history.

(56) References Cited

U.S. PATENT DOCUMENTS 4,630,398 A * 12/1986 Schust ..... E05F 11/485 403/41
4,685,350 A * 8/1987 Bauer ..... F16C 1/105 74/502.4
7,908,795 B2 * 3/2011 Arimoto ..... E05F 11/382 49/352
8,096,080 B2 * 1/2012 Pavlovic ..... E05F 11/382 49/348
2002/0139052 A1 * 10/2002 Messiez ..... E05F 11/483 49/375

(Continued)

FOREIGN PATENT DOCUMENTS

JP 2008231714 A 10/2008

*Primary Examiner* — Gregory J Strimbu
(74) *Attorney, Agent, or Firm* — Buchanan, Ingersoll & Rooney PC

(57) ABSTRACT

A window regulator includes: a carrier piece attached to a window glass; a drive wire connected to the carrier piece and configured to lift and lower the carrier piece; and a wire end connected to an end portion of the drive wire. The carrier piece has a wire end housing portion configured to house the wire end, a wire insertion groove communicating with the wire end housing portion, and a wire retaining portion extending at an upper end of the wire insertion groove. The drive wire is routed in the wire insertion groove. An upper side of the wire insertion groove includes an opening which opens in an upper direction crossing a routing direction of the drive wire. The wire retaining portion prevents the drive wire from coming out of the wire insertion groove by contacting the drive wire.

6 Claims, 9 Drawing Sheets

(56) References Cited

U.S. PATENT DOCUMENTS

| | | | | |
|---|---|---|---|---|
| 2008/0244981 | A1* | 10/2008 | Arimoto | E05F 11/385 49/352 |
| 2016/0047411 | A1* | 2/2016 | Simonneau | E05F 15/695 49/352 |
| 2018/0010379 | A1* | 1/2018 | Yamamoto | E05F 11/483 |
| 2019/0100953 | A1* | 4/2019 | Muramatsu | E05F 11/382 |
| 2019/0169900 | A1* | 6/2019 | Arimoto | E05F 11/485 |

* cited by examiner

WINDOW REGULATOR

CROSS-REFERENCE TO RELATED APPLICATION

This application claims priority from Japanese Patent Application No. 2017-213704 filed with the Japan Patent Office on Nov. 6, 2017, the entire content of which is hereby incorporated by reference.

BACKGROUND

1. Technical Field

The present disclosure relates to a window regulator.

2. Description of the Related Art

JP-A-2008-231714 discloses a wire type window regulator. In this wire type window regulator, a center fixing portion having a fixing hole and a wire holding portion extending up and down from the center fixing portion are provided at a wire end member fixed to a window glass and made of a metal material. A drive wire configured to lift/lower the window glass is inserted into a wire insertion hole formed at the wire holding portion. The wire holding portion is swaged to fix the drive wire. The wire insertion hole has a straight hole having a diameter corresponding to a drive wire diameter in a free state, and an expanded-diameter hole positioned at an outer end portion of the straight hole. A swaging region of the wire holding portion is set such that a non-swaging region across the entirety of the expanded-diameter hole and part of the straight hole remains at a tip end portion of the wire holding portion.

A type for lifting/lowering a carrier piece (a wire end member) fixed to a window glass relative to a guide rail fixed to a door panel has been known as the wire type window regulator. In addition, a so-called guideless window regulator without a guide rail has been known. In this guideless window regulator, a carrier piece fixed to a window glass is lifted/lowered in a hanging state by a drive wire.

As compared to the window regulator using the guide rail, the guideless window regulator has advantages that the guideless window regulator is more lightweight, exhibits higher performance (higher rotational stiffness) and higher layout performance (higher flexibility in layout), and is more easily standardized. Regarding higher flexibility in layout, a safety window can be attached, and inclination of a belt line can be increased, for example. Regarding standardization, the carrier piece does not need to be conformed to the form of the guide rail, for example.

SUMMARY

A window regulator includes: a carrier piece attached to a window glass; a drive wire connected to the carrier piece and configured to lift/lower the carrier piece; and a wire end connected to an end portion of the drive wire. The carrier piece has a wire end housing portion configured to house the wire end, a wire insertion groove communicating with the wire end housing portion, configured such that the drive wire is routed in the wire insertion groove, and configured such that an upper side of the wire insertion groove opens when a direction crossing a routing direction of the drive wire is an upper-to-lower direction, and a first wire retaining portion extending at an upper end of the wire insertion groove.

DESCRIPTION OF THE EMBODIMENTS

Figure 1:
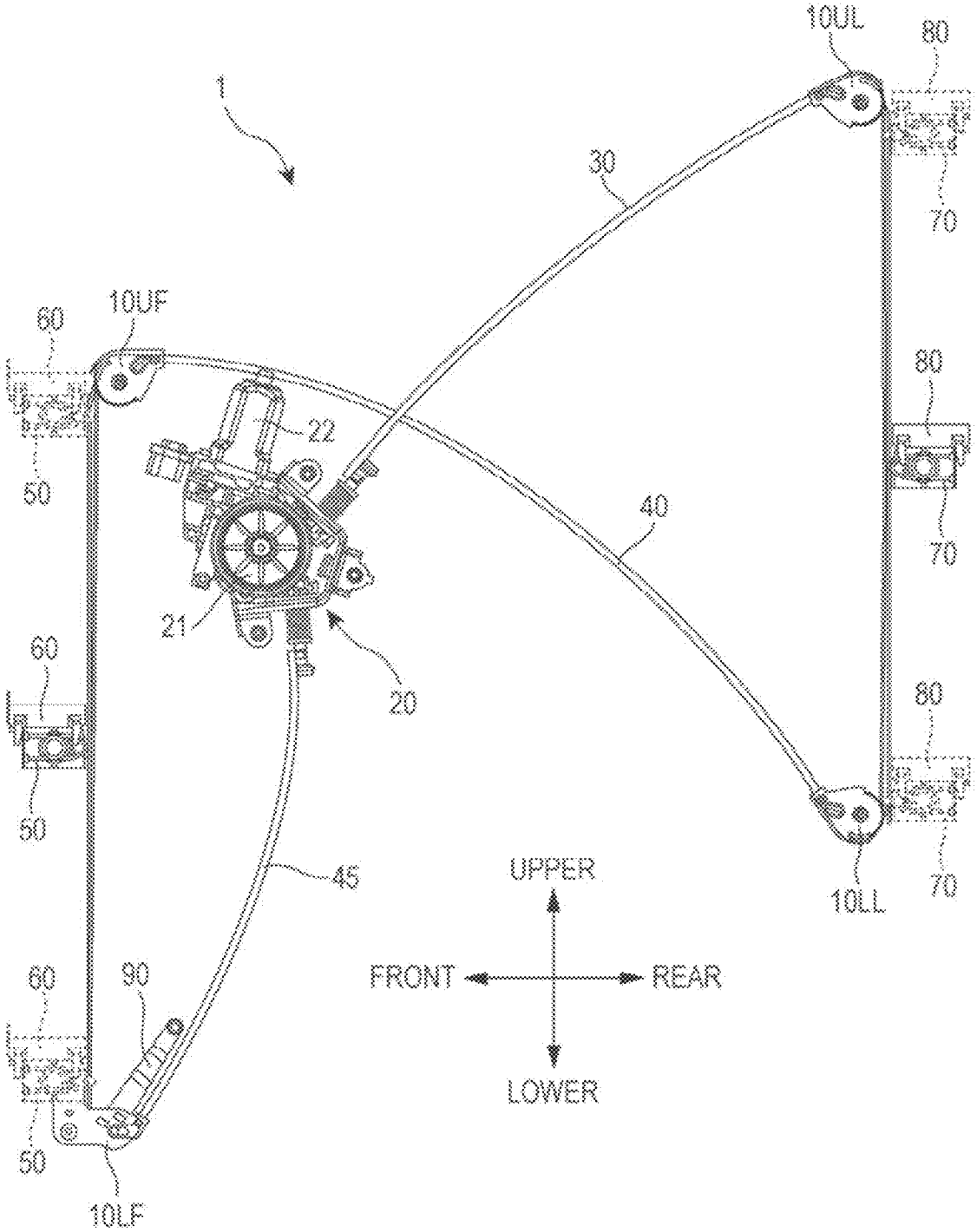
FIG. 1 is a front view of a configuration of a window regulator according to an embodiment.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Specifically, upon carrying in which no tension is on the drive wire, there is a probability that the drive wire of the guideless window regulator is detached from the carrier piece. Moreover, the drive wire and the carrier piece may be swaged together as in JP-A-2008-231714. However, this leads to a complicated structure of the carrier piece, and also leads to an increase in cycle time and cost for a swaging step.

One object of the present disclosure is to provide a window regulator configured so that a drive wire and a carrier piece can be easily assembled together and detachment of the drive wire from the carrier piece can be reduced.

A window regulator according to the embodiment includes: a carrier piece attached to a window glass; a drive wire connected to the carrier piece and configured to lift/lower the carrier piece; and a wire end connected to an end portion of the drive wire. The carrier piece has a wire end housing portion configured to house the wire end, a wire insertion groove communicating with the wire end housing portion, configured such that the drive wire is routed in the wire insertion groove, and configured such that an upper side of the wire insertion groove opens when a direction crossing a routing direction of the drive wire is an upper-to-lower direction, and a first wire retaining portion extending at an upper end of the wire insertion groove.

The carrier piece may have a second wire retaining portion configured to restrict movement of the drive wire in the direction of detachment from the wire insertion groove, and the second wire retaining portion may be apart from the first wire retaining portion in an extension direction of the wire insertion groove.

A pair of the drive wires separately extending after having crossed each other at a crossing portion and a pair of the wire insertion grooves separately extending after having crossed each other at the crossing portion may be provided, and the second wire retaining portion may extend above the pair of drive wires crossing each other at the crossing portion.

The carrier piece may have an insertion hole for inserting a fastening member configured to fasten the carrier piece into a glass holder holding the window glass, and the fastening member may be positioned above the drive wire in a state in which the fastening member is inserted into the insertion hole.

A through-hole facing the first wire retaining portion may be provided at the wire insertion groove, and the first wire retaining portion may be inclined from a side portion of the wire insertion groove toward above the through-hole.

According to the present embodiment, the window regulator can be provided, which is configured so that the drive wire and the carrier piece can be easily assembled together and detachment of the drive wire from the carrier piece can be reduced.

Figure 2:
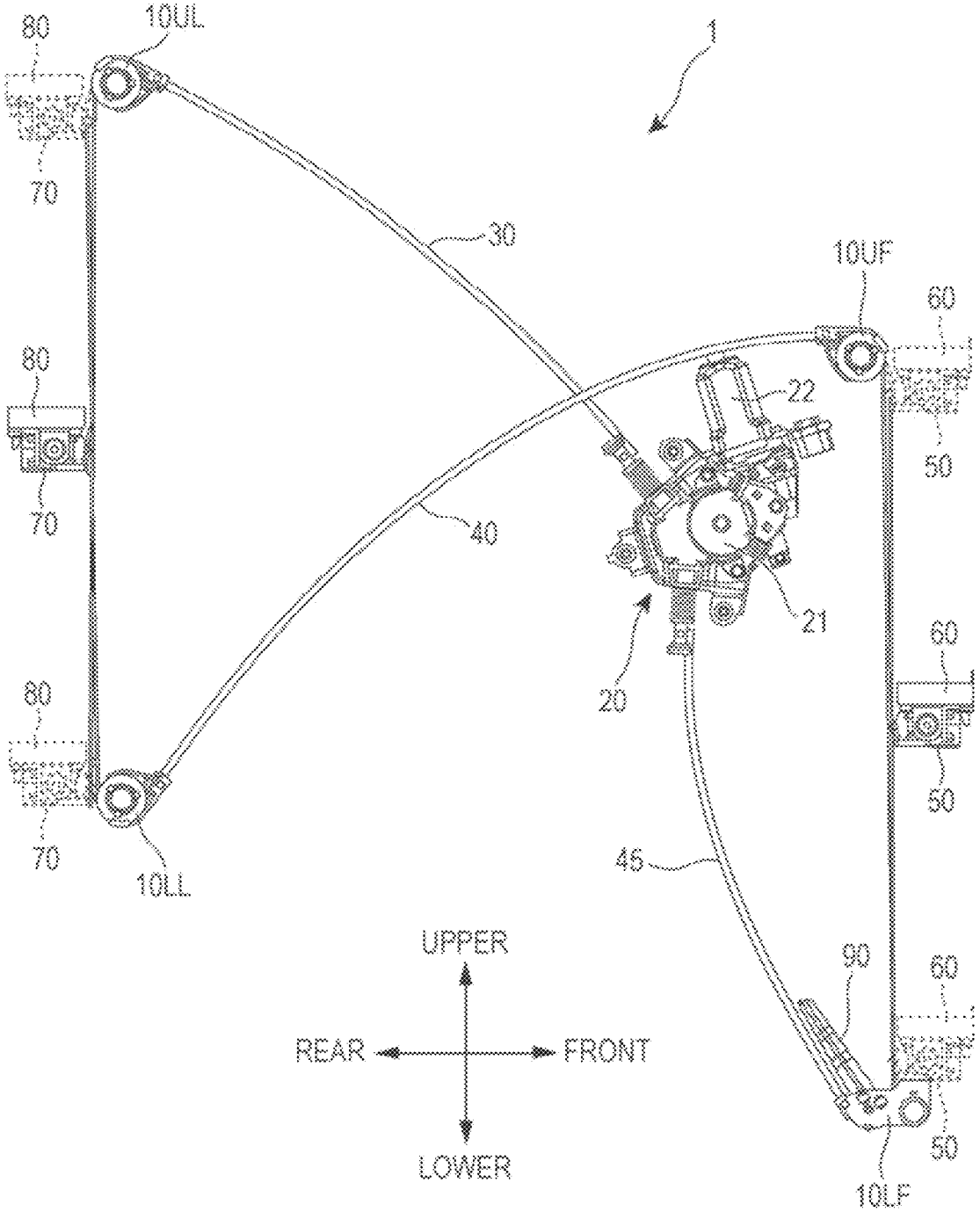
FIG. 2 is a back view of the configuration of the window regulator according to the embodiment.

Hereinafter, one embodiment of the present disclosure will be described in detail with reference to the drawings. FIGS. 1 and 2 are a front view (a view from a vehicle outer side) and a back view (a view from a vehicle inner side) of a configuration of a window regulator 1 according to the present embodiment. In description below, each direction of upper, lower, front, rear, vehicle inner, and vehicle outer sides is based on the directions of arrows illustrated in the figures. Moreover, the "vehicle outer side" in the figures corresponds to one example of a "top side" in the claims. The "front side" in the figures corresponds to one example of "one end side" in the claims. Further, the "rear side" in the figures corresponds to one example of the "other end side" in the claims.

The window regulator 1 is attached to a door panel (not shown) of a vehicle to lift/lower a window glass (not shown). The window regulator 1 has four wire guides 10UF, 10UL, 10LF, 10LL fixed to the door panel of the vehicle. The wire guide 10UF is arranged on the upper front side. The wire guide 10UL is arranged on the upper rear side. The wire guide 10LF is arranged on the lower front side. The wire guide 10LL is arranged on the lower rear side. A rotatable pulley (not shown) or an unrotatable guide member (not shown) is provided inside each wire guide 10UF, 10UL, 10LF, 10LL. A straight line connecting between the wire guide 10UF and the wire guide 10LF and a straight line connecting between the wire guide 10UL and the wire guide 10LL are substantially parallel to each other. A straight line connecting between the wire guide 10UF and the wire guide 10UL and a straight line connecting between the wire guide 10LF and the wire guide 10LL are substantially parallel to each other.

The window regulator 1 has a wire roll-up drive device 20 fixed to the door panel of the vehicle. The wire roll-up drive device 20 is positioned in a region surrounded by the wire guides 10UF, 10UL, 10LF, 10LL. The wire roll-up drive device 20 has a roll-up drum 21 and a motor 22 configured to rotatably drive the roll-up drum 21 forward or backward.

The window regulator 1 has a first drive wire 30, a second drive wire 40, and a third drive wire 45. One end portion of the first drive wire 30 is wound (locked) around the roll-up drum 21. The other end portion of the first drive wire 30 is bent downward after having been guided to the wire guide 10UL, and then, is locked at a rear carrier piece 70 (described later). One end portion of the second drive wire 40 is bent upward after having been guided to the wire guide 10LL, and then, is locked at the rear carrier piece 70 (described later). The other end portion of the second drive wire 40 is bent downward after having been guided to the wire guide 10UF, and then, is locked at a front carrier piece 50 (described later). One end portion of the third drive wire 45 is wound (locked) around the roll-up drum 21. The other end portion of the third drive wire 45 is bent upward after having been guided to the wire guide 10LF, and then, is locked at the front carrier piece 50 (described later).

Figure 3:
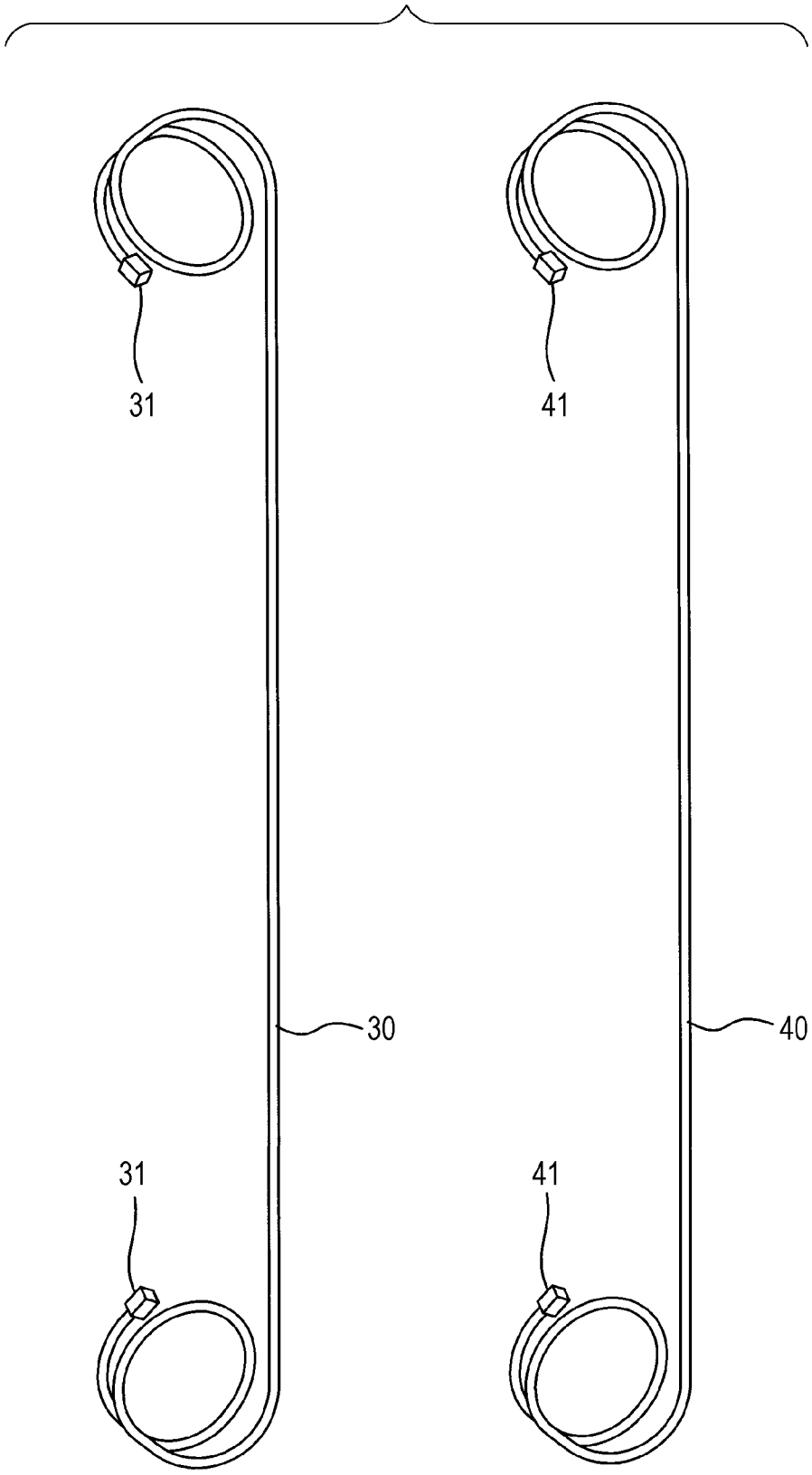
FIG. 3 illustrates configurations of a first drive wire and a second drive wire.

FIG. 3 is a view of configurations of the first drive wire 30 and the second drive wire 40. The first drive wire 30 and the second drive wire 40 are, for example, formed by twisting of multiple strands. The first drive wire 30 and the second drive wire 40 are configured such that in a natural state, the strands closely contact each other from a macro perspective and a clearance is present among the strands from a micro perspective. Each strand is formed in such a manner that several to several tens of element wires are twisted together. Substantially rectangular parallelepiped locking head portions (wire ends) 31 are each connected to both end portions of the first drive wire 30. Substantially rectangular parallelepiped locking head portions (wire ends) 41 are each connected to both end portions of the second drive wire 40. Note that the third drive wire 45 also has the same configuration as those of the first drive wire 30 and the second drive wire 40.

The window regulator 1 has the front carrier piece 50. The front carrier piece 50 is joined to a tip end portion of the third drive wire 45 bent upward from the wire guide 10LF and a tip end portion of the second drive wire 40 bent downward from the wire guide 10UF. A front glass holder 60 configured to hold a lower front end of the window glass is fixed to the front carrier piece 50. That is, the lower front end of the window glass is indirectly attached to the front carrier piece 50 through the front glass holder 60. FIGS. 1 and 2 illustrate the top dead point positions, bottom dead point positions, and intermediate positions of the front carrier piece 50 and the front glass holder 60 (the window glass).

The window regulator 1 has the rear carrier piece 70. The rear carrier piece 70 is joined to a tip end portion of the first drive wire 30 bent downward from the wire guide 10UL and a tip end portion of the second drive wire 40 bent upward from the wire guide 10LL. A rear glass holder 80 configured to hold a lower rear end of the window glass is fixed to the rear carrier piece 70. That is, the lower rear end of the window glass is indirectly attached to the rear carrier piece 70 through the rear glass holder 80. FIGS. 1 and 2 illustrate the top dead point positions, bottom dead point positions, and intermediate positions of the rear carrier piece 70 and the rear glass holder 80 (the window glass).

The wire guides 10UF, 10UL, 10LF, 10LL, the wire roll-up drive device 20, the first drive wire 30, the second drive wire 40, the third drive wire 45, the front carrier piece 50, the front glass holder 60, the rear carrier piece 70, and the rear glass holder 80 are temporarily assembled with the door panel of the vehicle. In this state, a tension application member 90 provided in the vicinity of the wire guide 10LF is rotated using a special tool (not shown) to apply tension to the first drive wire 30, the second drive wire 40, and the third drive wire 45. That is, the window regulator 1 is attached to the vehicle, and accordingly, tension is applied to the first drive wire 30, the second drive wire 40, and the third drive wire 45.

When the roll-up drum 21 is rotatably driven forward or backward through the motor 22 of the wire roll-up drive device 20, one of the first drive wire 30 or the third drive wire 45 is rolled up, and the other one of the first drive wire 30 or the third drive wire 45 is rolled out. As a result, the window glass (the front carrier piece 50, the front glass holder 60, the rear carrier piece 70, and the rear glass holder 80) is lifted/lowered.

The window regulator 1 is a so-called guideless window regulator without a guide rail. That is, in the window regulator 1, the front carrier piece 50, the front glass holder 60, the rear carrier piece 70, and the rear glass holder 80 holding the window glass are, in a hanging state, lifted/lowered by the first drive wire 30, the second drive wire 40, and the third drive wire 45.

As compared to a window regulator using a guide rail, the guideless window regulator has advantages that the guideless window regulator is more lightweight, exhibits higher performance (higher rotational stiffness) and higher layout performance (higher flexibility in layout), and is more easily standardized. Regarding higher flexibility in layout, a safety window can be attached, and inclination of a belt line can be increased, for example. Regarding standardization, the carrier piece does not need to be conformed to the form of the guide rail, for example.

An assembly structure of the first drive wire 30, the second drive wire 40, and the rear carrier piece 70 will be described in detail with reference to FIGS. 4 to 9. The assembly structure of the first drive wire 30, the second drive wire 40, and the rear carrier piece 70 as described herein is the same (symmetrical) as an assembly structure of the second drive wire 40, the third drive wire 45, and the front carrier piece 50.

The rear carrier piece 70 is offset-arranged at the rear of the wire guide 10UL and the wire guide 10LL. The first drive wire 30 bent downward from the wire guide 10UL and the second drive wire 40 bent upward from the wire guide 10LL cross each other at a crossing portion CS. Thereafter, the first drive wire 30 and the second drive wire 40 are separately guided to the rear side, and then, are connected to the rear carrier piece 70. At the crossing portion CS described herein, the first drive wire 30 is positioned on the vehicle outer side, whereas the second drive wire 40 is positioned on the vehicle inner side. Note that such a position relationship may be inverted.

As described above, the rear carrier piece 70 is offset-arranged, and the first drive wire 30 and the second drive wire 40 are in cross routing. Thus, at the top dead point position of the window glass, the rear carrier piece 70 is lifted to a position substantially immediately lateral to the wire guide 10UL. Moreover, at the bottom dead point position of the window glass, the rear carrier piece 70 is lowered to a position substantially immediately lateral to the wire guide 10LL. Accordingly, a long window glass lifting/lowering stroke can be ensured.

The rear carrier piece 70 has a first wire insertion groove (a first wire insertion portion) 71 and a second wire insertion groove (a second wire insertion portion) 72. The first wire insertion groove 71 extends backward after having extended once diagonally from the crossing portion CS toward the lower rear side. The second wire insertion groove 72 extends backward after having extended once diagonally from the crossing portion CS toward the upper rear side. The first drive wire 30 is routed (inserted) in the first wire insertion groove 71. Further, when a direction crossing a routing direction of the first drive wire 30 is an upper-to-lower direction, the first wire insertion groove 71 opens to the upper side (the vehicle outer side). The second drive wire 40 is routed (inserted) in the second wire insertion groove 72. Further, when a direction crossing a routing direction of the second drive wire 40 is the upper-to-lower direction, the second wire insertion groove 72 opens to the upper side (the vehicle outer side). The first wire insertion groove 71 and the second wire insertion groove 72 are arranged such that the positions thereof in a vehicle width direction are offset from each other. That is, the first wire insertion groove 71 is positioned on the vehicle outer side, whereas the second wire insertion groove 72 is positioned on the vehicle inner side. This is because cross routing of the first drive wire 30 and the second drive wire 40 is allowed in the vicinity of the crossing portion CS.

Figure 4:
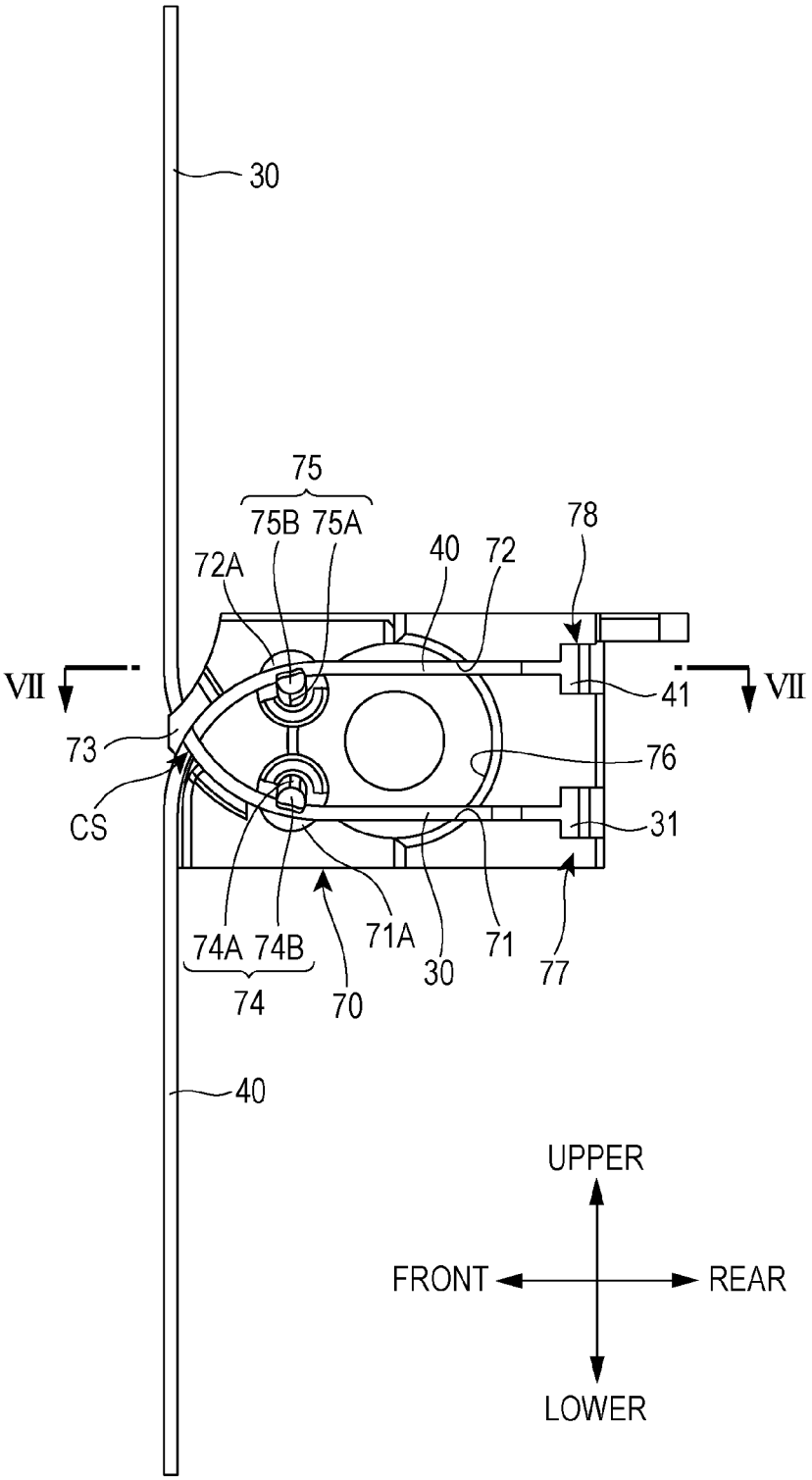
FIG. 4 illustrates, from a vehicle outer side, an assembly structure of the first drive wire, the second drive wire, and a rear carrier piece.
Figure 5:
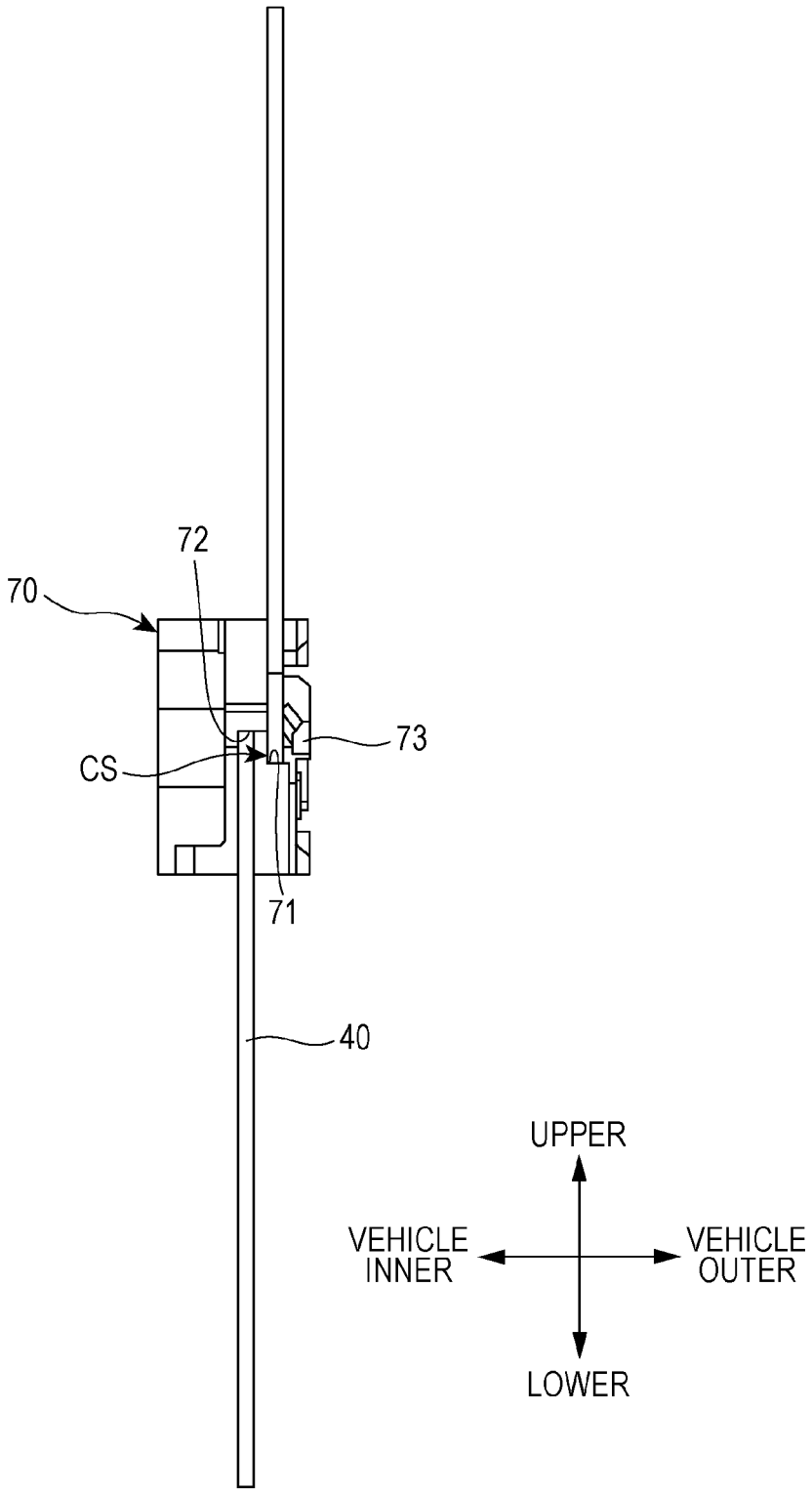
FIG. 5 illustrates, from the front, the assembly structure of the first drive wire, the second drive wire, and the rear carrier piece.
Figure 6:
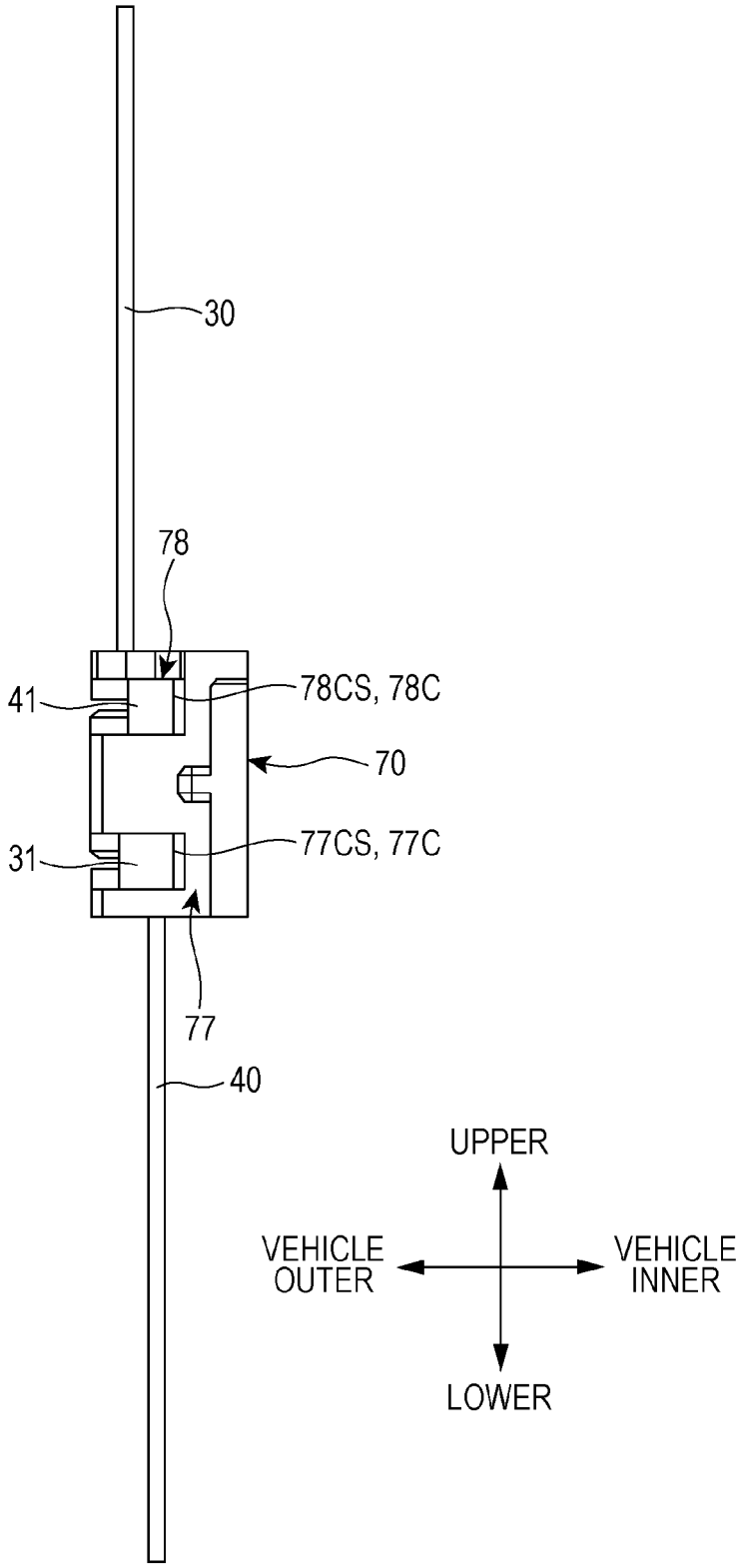
FIG. 6 illustrates, from the rear, the assembly structure of the first drive wire, the second drive wire, and the rear carrier piece.
Figure 7:
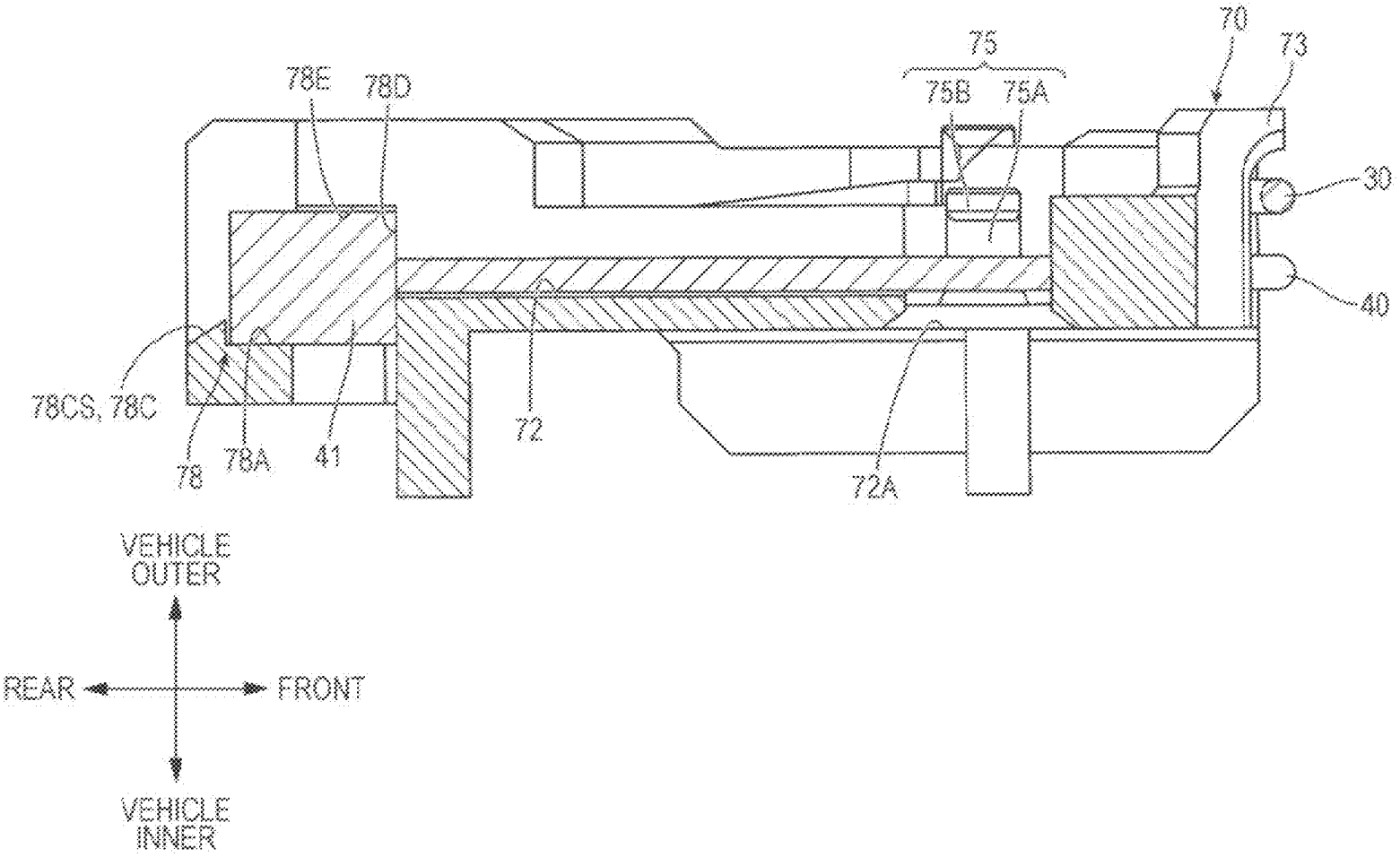
FIG. 7 is a sectional view along a VII-VII line of FIG. 4.
Figure 8:
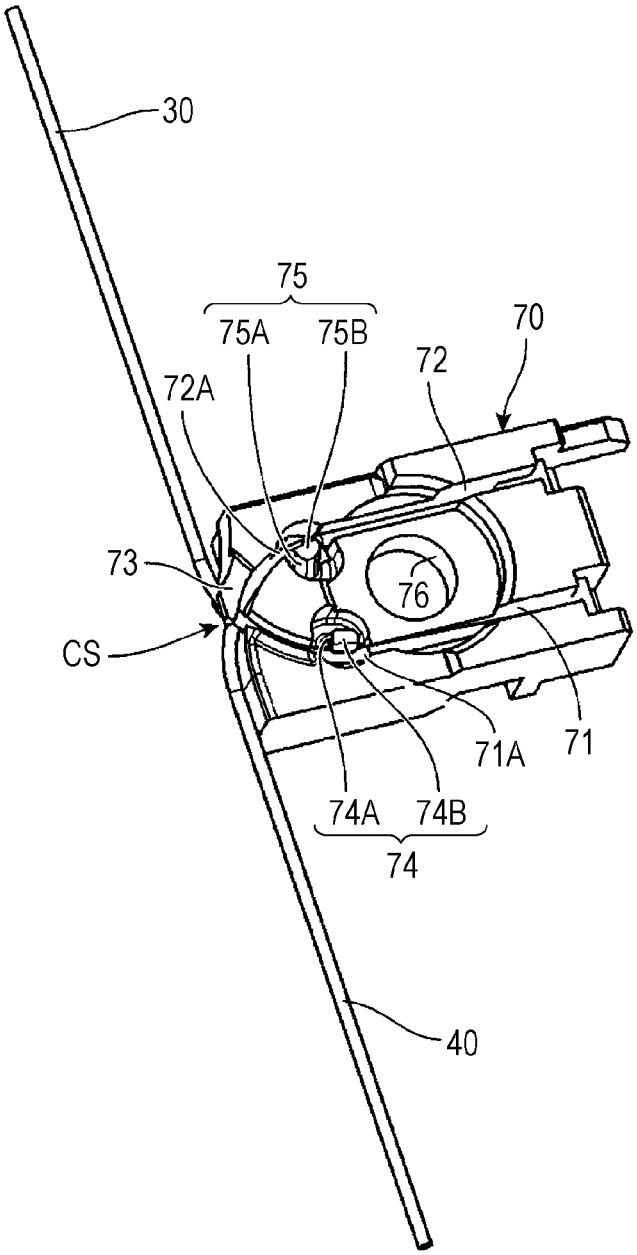
FIG. 8 is a perspective view of the assembly structure of the first drive wire, the second drive wire, and the rear carrier piece.

The rear carrier piece 70 has a common wire retaining claw (a second wire retaining portion) 73 in the vicinity of the crossing portion CS as a starting point position of the first wire insertion groove 71 and the second wire insertion groove 72. The common wire retaining claw 73 extends above a portion where the first drive wire 30 and the second drive wire 40 cross each other. The common wire retaining claw 73 reduces detachment of the first drive wire 30 in a direction away from the first wire insertion groove 71, and reduces detachment of the second drive wire 40 in a direction away from the second wire insertion groove 72. More specifically, the second drive wire 40 is retained by the first drive wire 30 and the common wire retaining claw 73 positioned immediately above the second drive wire 40. The first drive wire 30 is retained by the common wire retaining claw 73 positioned immediately above the first drive wire 30 (FIGS. 4 and 5).

Figure 9:
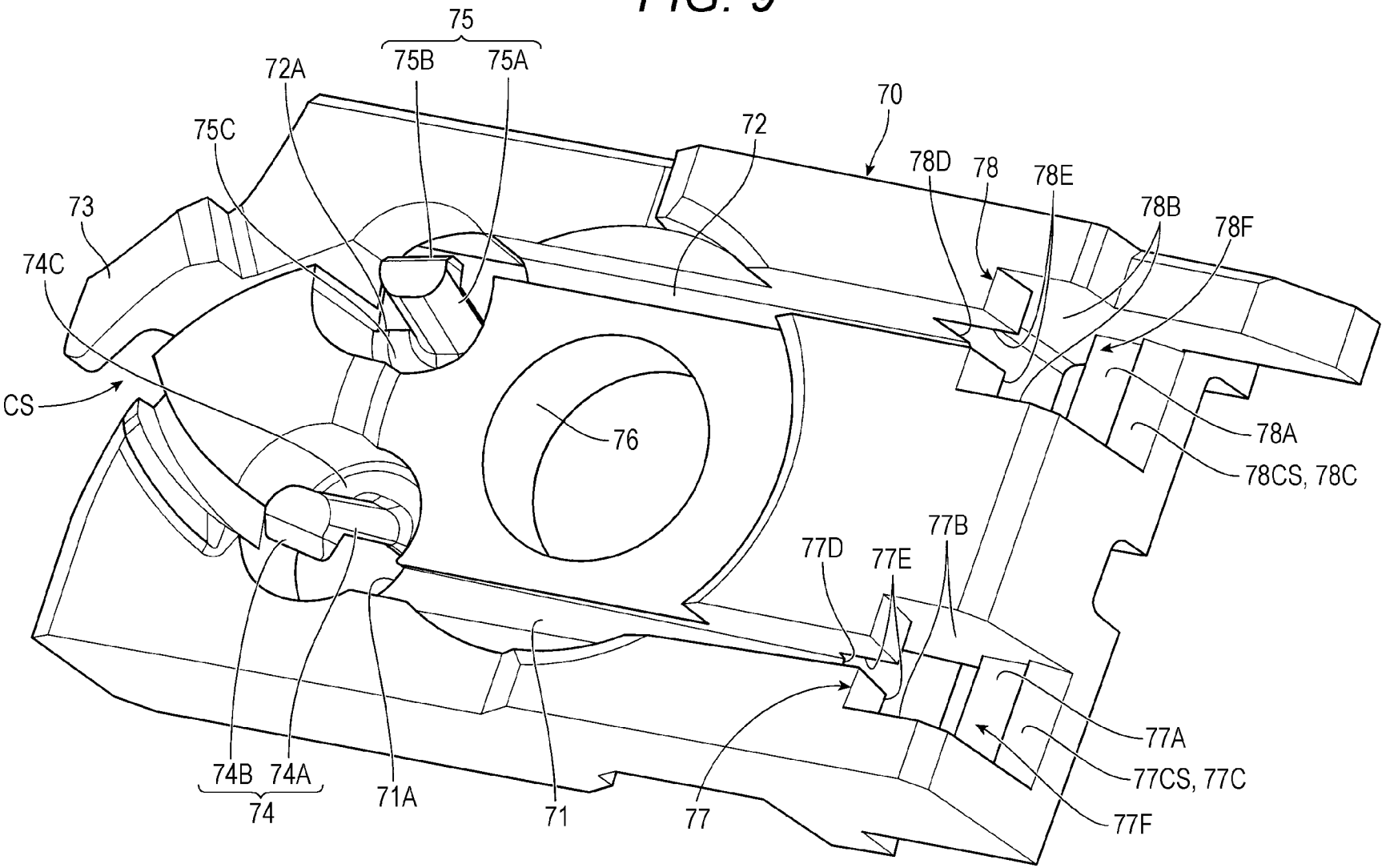
FIG. 9 is a perspective view of a structure of the single rear carrier piece.

A first wire retaining claw (a first wire retaining portion) 74 is formed at a middle portion of the first wire insertion groove 71 in a front-to-rear direction. The first wire retaining claw 74 extends from a side portion of the first wire insertion groove 71 to above the first drive wire 30 (an upper end of the first wire insertion groove 71). The first wire retaining claw 74 reduces detachment of the first drive wire 30 in the direction away from the first wire insertion groove 71. The first wire retaining claw 74 has an elastic leg portion 74A extending upward diagonally from the side portion of the first wire insertion groove 71, and a locking claw portion 74B bending upward of the first wire insertion groove 71 from a tip end portion of the elastic leg portion 74A. Of the first wire insertion groove 71, a portion positioned immediately below the first wire retaining claw 74 is provided with a lightening portion (a through-hole) 71A facing the first wire retaining claw 74. The elastic leg portion 74A of the first wire retaining claw 74 is inclined upward of the lightening portion 71A from the side portion of the first wire insertion groove 71. Moreover, on an inner peripheral side (a side close to the second wire insertion groove 72) of the first wire insertion groove 71, an arc-shaped cutout portion 74C surrounding the elastic leg portion 74A of the first wire retaining claw 74 is formed (FIG. 9). The special tool (not shown) is inserted from the lightening portion 71A to contact the elastic leg portion 74A so that the elastic leg portion 74A can be elastically deformed toward the side portion of the first wire insertion groove 71. At an upper surface of the locking claw portion 74B, a tapered surface is formed so that the first drive wire 30 can be guided to the first wire insertion groove 71 without use of the special tool.

A second wire retaining claw (a first wire retaining portion) 75 is formed at a middle portion of the second wire insertion groove 72 in the front-to-rear direction. The second wire retaining claw 75 extends from a side portion of the second wire insertion groove 72 to above the second drive wire 40 (an upper end of the second wire insertion groove 72). The second wire retaining claw 75 reduces detachment of the second drive wire 40 in the direction away from the second wire insertion groove 72. The second wire retaining claw 75 has an elastic leg portion 75A extending upward diagonally from the side portion of the second wire insertion groove 72, and a locking claw portion 75B bending upward of the second wire insertion groove 72 from a tip end portion of the elastic leg portion 75A. Of the second wire insertion groove 72, a portion positioned immediately below the second wire retaining claw 75 is provided with a lightening portion (a through-hole) 72A facing the second wire retaining claw 75. The elastic leg portion 75A of the second wire retaining claw 75 is inclined upward of the lightening portion 72A from the side portion of the second wire insertion groove 72. Moreover, on an inner peripheral side (a side close to the first wire insertion groove 71) of the second wire insertion groove 72, an arc-shaped cutout portion 75C surrounding the elastic leg portion 75A of the second wire retaining claw 75 is formed (FIG. 9). The special tool (not shown) is inserted from the lightening portion 72A to contact the elastic leg portion 75A so that the elastic leg portion 75A can be elastically deformed toward the side portion of the second wire insertion groove 72. At an upper surface of the locking claw portion 75B, a tapered surface is formed so that the second drive wire 40 can be guided to the second wire insertion groove 72 without use of the special tool.

When the first drive wire 30 is inserted into the first wire insertion groove 71, the common wire retaining claw 73 and the first wire retaining claw 74 (the first wire retaining portion and the second wire retaining portion) provided apart from each other in an extension direction of the first wire insertion groove 71 function as two members for restricting (reducing detachment) movement of the first drive wire 30 in the direction of detachment from the first wire insertion groove 71.

When the second drive wire 40 is inserted into the second wire insertion groove 72, the common wire retaining claw 73 and the second wire retaining claw 75 (the first wire retaining portion and the second wire retaining portion) provided apart from each other in an extension direction of the second wire insertion groove 72 function as two members for restricting (reducing detachment) movement of the second drive wire 40 in the direction of detachment from the second wire insertion groove 72.

The rear carrier piece 70 has an insertion hole 76. A fastening member (e.g., a fastening bolt: not shown) configured to fasten the rear carrier piece 70 to the rear glass holder 80 holding the window glass is inserted into the insertion hole 76. In a state in which the fastening member is inserted into the insertion hole 76, the fastening member is positioned to extend over the first drive wire 30 and the first wire retaining claw 74 and over the second drive wire 40 and the second wire retaining claw 75. That is, the first drive wire 30 is doubly retained by the first wire retaining claw 74 and the fastening member. The second drive wire 40 is doubly retained by the second wire retaining claw 75 and the fastening member.

As mainly illustrated in FIG. 9, the rear carrier piece 70 has, at an ending point position of the first wire insertion groove 71, a first locking portion (a first wire end housing portion) 77 configured to lock (house) the locking head portion (the wire end) 31 of the first drive wire 30. The first locking portion 77 has a bottom wall portion (a bottom wall) 77A, a pair of opposing wall portions 77B, a tip end side retaining wall portion (the other end wall) 77C, a base end side retaining wall portion (one end wall) 77D, and a ceiling side retaining wall portion (a top wall) 77E. Moreover, the first locking portion 77 has an opening 77F opening in a diagonal direction including a top side and the other end side. Note that the opening 77F may at least open on the top side (the top side may open, and the other end side may be closed).

The locking head portion 31 of the first drive wire 30 is mounted on the bottom wall portion 77A. The pair of opposing wall portions 77B faces in the upper-to-lower direction with the bottom wall portion 77A being interposed between the opposing wall portions 77B. The pair of opposing wall portions 77B is configured to restrict the position of the locking head portion 31 of the first drive wire 30 in the upper-to-lower direction, the locking head portion 31 being mounted on the bottom wall portion 77A.

The tip end side retaining wall portion 77C has an inclined wall portion (an inclined wall) 77CS. The inclined wall portion 77CS stands from the bottom wall portion 77A. The amount of standing of the inclined wall portion 77CS from the bottom wall portion 77A increases from a tip end side (the other end side) to a base end side (one end side). The tip end side retaining wall portion 77C (the inclined wall portion 77CS) is configured to contact the tip end side (the other end side) of the locking head portion 31 of the first drive wire 30. With this configuration, the tip end side retaining wall portion 77C (the inclined wall portion 77CS) restricts movement of the locking head portion 31 of the first drive wire 30 in the direction of detachment from the tip end side (the other end side) of the opening 77F such that the locking head portion 31 of the first drive wire 30 and the ceiling side retaining wall portion 77E overlap with each other as viewed from the top. The inclined wall portion 77CS is provided at the tip end side retaining wall portion 77C so that movement of the locking head portion 31 of the first drive wire 30 can be favorably restricted. Note that the inclined wall portion 77CS of the tip end side retaining wall portion 77C is not an essential element. A form can be employed, in which the inclined wall portion 77CS is omitted (the tip end side retaining wall portion 77C is a step portion with the same height).

The base end side retaining wall portion 77D communicates with the first wire insertion groove 71, and is formed in a forked shape on both sides of the first wire insertion groove 71. The base end side retaining wall portion 77D contacts the base end side (one end side) of the locking head portion 31 of the first drive wire 30 to reduce detachment of the locking head portion 31 of the first drive wire 30 to the base end side (one end side). The ceiling side retaining wall portion 77E is formed in a forked shape on both sides of the first wire insertion groove 71. The ceiling side retaining wall portion 77E contacts a ceiling side of the locking head portion 31 of the first drive wire 30 to restrict movement of the locking head portion 31 of the first drive wire 30 in the direction of detachment from the top side of the opening 77F.

The bottom wall portion 77A, the pair of opposing wall portions 77B, the tip end side retaining wall portion 77C, the base end side retaining wall portion 77D, and the ceiling side retaining wall portion 77E define a rectangular parallelepiped housing space. The shape and volume of the housing space are set equal to or slightly larger than those of the locking head portion 31 of the first drive wire 30.

As mainly illustrated in FIG. 9, the rear carrier piece 70 has, at an ending point position of the second wire insertion groove 72, a second locking portion (a second wire end housing portion) 78 configured to lock (house) the locking head portion (the wire end) 41 of the second drive wire 40. The second locking portion 78 has a bottom wall portion (a bottom wall) 78A, a pair of opposing wall portions 78B, a tip end side retaining wall portion (the other end wall) 78C, a base end side retaining wall portion (one end wall) 78D, and a ceiling side retaining wall portion (a top wall) 78E. Moreover, the second locking portion 78 has an opening 78F opening in the diagonal direction including the top side and the other end side. Note that the opening 78F may at least open on the top side (the top side may open, and the other end side may be closed).

The locking head portion 41 of the second drive wire 40 is mounted on the bottom wall portion 78A. The pair of opposing wall portions 78B faces in the upper-to-lower direction with the bottom wall portion 78A being interposed therebetween. The pair of opposing wall portions 78B is configured to restrict the position of the locking head portion 41 of the second drive wire 40 in the upper-to-lower direction, the locking head portion 41 being mounted on the bottom wall portion 78A.

The tip end side retaining wall portion 78C has an inclined wall portion (an inclined wall) 78CS. The inclined wall portion 78CS stands from the bottom wall portion 78A. The amount of standing of the inclined wall portion 78CS from the bottom wall portion 78A increases from the tip end side (the other end side) to the base end side (one end side). The tip end side retaining wall portion 78C (the inclined wall portion 78CS) is configured to contact the tip end side (the other end side) of the locking head portion 41 of the second drive wire 40. With this configuration, the tip end side retaining wall portion 78C (the inclined wall portion 78CS) restricts movement of the locking head portion 41 of the second drive wire 40 in the direction of detachment from the tip end side (the other end side) of the opening 78F such that the locking head portion 41 of the second drive wire 40 and the ceiling side retaining wall portion 78E overlap with each other as viewed from the top. The inclined wall portion 78CS is provided at the tip end side retaining wall portion 78C so that movement of the locking head portion 41 of the second drive wire 40 can be favorably restricted. Note that the inclined wall portion 78CS of the tip end side retaining wall portion 78C is not an essential element. A form can be employed, in which the inclined wall portion 78CS is omitted (the tip end side retaining wall portion 78C is a step portion with the same height).

The base end side retaining wall portion 78D communicates with the second wire insertion groove 72, and is formed in a forked shape on both sides of the second wire insertion groove 72. The base end side retaining wall portion 78D contacts the base end side (one end side) of the locking head portion 41 of the second drive wire 40 to reduce detachment of the locking head portion 41 of the second drive wire 40 to the base end side (one end side). The ceiling side retaining wall portion 78E is formed in a forked shape on both sides of the second wire insertion groove 72. The ceiling side retaining wall portion 78E contacts the ceiling side of the locking head portion 41 of the second drive wire 40 to restrict movement of the locking head portion 41 of the second drive wire 40 in the direction of detachment from the top side of the opening 78F.

The bottom wall portion 78A, the pair of opposing wall portions 78B, the tip end side retaining wall portion 78C, the base end side retaining wall portion 78D, and the ceiling side retaining wall portion 78E define a rectangular parallelepiped housing space. The shape and volume of the housing space are set equal to or slightly larger than those of the locking head portion 41 of the second drive wire 40.

The first drive wire 30, the second drive wire 40, and the rear carrier piece 70 configured as described above are assembled as follows in a sub-assembly state before attachment to the door panel of the vehicle.

The locking head portion 31 of the first drive wire 30 is injected into the housing space of the first locking portion 77 over the inclined wall portion 77CS of the tip end side retaining wall portion 77C through (the opening 77F) between the tip end side retaining wall portion 77C and the ceiling side retaining wall portion 77E. At this insertion step, the first drive wire 30 is elastically deformed relative to the locking head portion 31. At the moment that the locking head portion 31 moves over the inclined wall portion 77CS of the tip end side retaining wall portion 77C, the first drive wire 30 is elastically recovered relative to the locking head portion 31. Accordingly, the locking head portion 31 of the first drive wire 30 is, with a feeling of click, fitted in the housing space of the first locking portion 77 with the minimum clearance. In this fitting state, the position of the locking head portion 31 of the first drive wire 30 is restricted by the bottom wall portion 77A, the pair of opposing wall portions 77B, the tip end side retaining wall portion 77C, the base end side retaining wall portion 77D, and the ceiling side retaining wall portion 77E. Thus, the locking head portion 31 is less detachable from the housing space of the first locking portion 77.

The locking head portion 41 of the second drive wire 40 is injected into the housing space of the second locking portion 78 over the inclined wall portion 78CS of the tip end side retaining wall portion 78C through (the opening 78F) between the tip end side retaining wall portion 78C and the ceiling side retaining wall portion 78E. At this insertion step, the second drive wire 40 is elastically deformed relative to the locking head portion 41. At the moment that the locking head portion 41 moves over the inclined wall portion 78CS of the tip end side retaining wall portion 78C, the second drive wire 40 is elastically recovered relative to the locking head portion 41. Accordingly, the locking head portion 41 of the second drive wire 40 is, with a feeling of click, fitted in the housing space of the second locking portion 78 with the minimum clearance. In this fitting state, the position of the locking head portion 41 of the second drive wire 40 is restricted by the bottom wall portion 78A, the pair of opposing wall portions 78B, the tip end side retaining wall portion 78C, the base end side retaining wall portion 78D, and the ceiling side retaining wall portion 78E. Thus, the locking head portion 41 is less detachable from the housing space of the second locking portion 78.

The elastic leg portion 74A is elastically deformed toward the side portion of the first wire insertion groove 71 in such a manner that the special tool (not shown) is inserted from the lightening portion 71A to contact the elastic leg portion 74A. Accordingly, the first drive wire 30 is guided to the first wire insertion groove 71. Thereafter, when the special tool is detached from the lightening portion 71A, the elastic leg portion 74A is elastically recovered, and the locking claw portion 74B is positioned above the first drive wire 30 inserted into the first wire insertion groove 71. As a result, the first drive wire 30 is retained.

The elastic leg portion 75A is elastically deformed toward the side portion of the second wire insertion groove 72 in such a manner that the special tool (not shown) is inserted from the lightening portion 72A to contact the elastic leg portion 75A. Accordingly, the second drive wire 40 is guided to the second wire insertion groove 72. Thereafter, when the special tool is detached from the lightening portion 72A, the elastic leg portion 75A is elastically recovered, and the locking claw portion 75B is positioned above the second drive wire 40 inserted into the second wire insertion groove 72. As a result, the second drive wire 40 is retained.

In the vicinity of the crossing portion CS between the first wire insertion groove 71 and the second wire insertion groove 72, the first drive wire 30 and the second drive wire 40 are guided to below the common wire retaining claw 73. Accordingly, the first drive wire 30 and the second drive wire 40 are retained by the common wire retaining claw 73.

As described above, the first drive wire 30, the second drive wire 40, and the rear carrier piece 70 can be easily assembled without the need for special configuration and step as in, e.g., swaging in JP-A-2008-231714.

In a case where the window regulator 1 as described in the present embodiment is carried in the sub-assembly state, no tension is on the first drive wire 30 and the second drive wire 40. Thus, in a typical window regulator, there is a probability that a drive wire is detached from a carrier piece. However, in the present embodiment, the tip end side retaining wall portion 77C reduces detachment of the locking head portion 31 of the first drive wire 30 to the tip end side, and the tip end side retaining wall portion 78C reduces detachment of the locking head portion 41 of the second drive wire 40 to the tip end side. Moreover, the common wire retaining claw 73 and the first wire retaining claw 74 reduce detachment of the first drive wire 30 from the first wire insertion groove 71, and the common wire retaining claw 73 and the second wire retaining claw 75 reduce detachment of the second drive wire 40 from the second wire insertion groove 72. With this configuration, even upon carrying in which no tension is on the first drive wire 30 and the second drive wire 40, detachment of the first drive wire 30 and the second drive wire 40 from the rear carrier piece 70 can be reduced.

In a use state in which the guideless window regulator 1 is attached to the door panel of the vehicle, tension is on the first drive wire 30 and the second drive wire 40. Thus, there is a low probability that the locking head portion 31 of the first drive wire 30 and the locking head portion 41 of the second drive wire 40 are detached from the first locking portion 77 and the second locking portion 78. However, external force in the vehicle width direction, i.e., external force in the direction of detaching the first drive wire 30 and the second drive wire 40 from the first wire insertion groove 71 and the second wire insertion groove 72, is applied to the first drive wire 30 and the second drive wire 40. However, in the present embodiment, the common wire retaining claw 73 and the first wire retaining claw 74 reduces detachment of the first drive wire 30 from the first wire insertion groove 71, and the common wire retaining claw 73 and the second wire retaining claw 75 reduces detachment of the second drive wire 40 from the second wire insertion groove 72. With this configuration, even in the use state in which the guideless window regulator 1 is attached to the door panel of the vehicle, detachment of the first drive wire 30 and the second drive wire 40 from the rear carrier piece 70 can be reduced.

In the above-described embodiment, the case where the rear carrier piece 70 has the tip end side retaining wall portion 77C, the tip end side retaining wall portion 78C, the common wire retaining claw 73, the first wire retaining claw 74, the common wire retaining claw 73, and the second wire retaining claw 75 has been described as one example. In this example, the tip end side retaining wall portion 77C reduces detachment of the locking head portion 31 of the first drive wire 30 to the tip end side. The tip end side retaining wall portion 78C reduces detachment of the locking head portion 41 of the second drive wire 40 to the tip end side. The common wire retaining claw 73 and the first wire retaining claw 74 reduce detachment of the first drive wire 30 from the first wire insertion groove 71. The common wire retaining claw 73 and the second wire retaining claw 75 reduces detachment of the second drive wire 40 from the second wire insertion groove 72.

However, the rear carrier piece 70 may have only the tip end side retaining wall portion 77C configured to reduce detachment of the locking head portion 31 of the first drive wire 30 to the tip end side, and the tip end side retaining wall portion 78C configured to reduce detachment of the locking head portion 41 of the second drive wire 40 to the tip end side. Alternatively, the rear carrier piece 70 may have only the common wire retaining claw 73 and the first wire retaining claw 74 configured to reduce detachment of the first drive wire 30 from the first wire insertion groove 71, and the common wire retaining claw 73 and the second wire retaining claw 75 configured to reduce detachment of the second drive wire 40 from the second wire insertion groove 72.

In the example described above in the embodiment, the lower front end of the window glass is indirectly attached to the front carrier piece 50 through the front glass holder 60. Further, the lower rear end of the window glass is indirectly attached to the rear carrier piece 70 through the rear glass holder 80. However, using a front carrier piece configured such that the front carrier piece 50 and the front glass holder 60 are integrated together, the lower front end of the window glass may be directly attached to such a front carrier piece. Further, using a rear carrier piece configured such that the rear carrier piece 70 and the rear glass holder 80 are integrated together, the lower rear end of the window glass may be directly attached to such a rear carrier piece.

In the example described above in the embodiment, the rear carrier piece 70 is offset-arranged with respect to the wire guide 10UL and the wire guide 10LL, and the first drive wire 30 and the second drive wire 40 are in cross routing. With this configuration, a long window glass lifting/lowering stroke is ensured. However, the rear carrier piece 70 is not necessarily offset-arranged with respect to the wire guide 10UL and the wire guide 10LL, and may be arranged between the wire guide 10UL and the wire guide 10LL. In this case, cross routing of the first drive wire 30 and the second drive wire 40 is not necessary.

In the above-described embodiment, the case where the front carrier piece 50 and the rear carrier piece 70 hold the window glass in cooperation has been described as one example. Instead, a form can be employed, in which the window glass is independently held by separate carrier pieces.

The embodiment of the present disclosure may be the following first to fifth window regulators.

A first window regulator has a carrier piece attached to a window glass, a drive wire connected to the carrier piece and configured to lift/lower the carrier piece, and a wire end connected to an end portion of the drive wire. In the window regulator in which tension is applied to the drive wire upon attachment to a vehicle, the carrier piece has a wire end housing portion configured to house the wire end, a wire insertion groove communicating with the wire end housing portion, configured such that the drive wire is routed in the wire insertion groove, and configured such that an upper side of the wire insertion groove opens when a direction crossing a routing direction of the drive wire is an upper-to-lower direction, and a first wire retaining portion extending at an upper end of the wire insertion groove.

A second window regulator is the first window regulator in which the carrier piece has a second wire retaining portion positioned apart from the first wire retaining portion in an extension direction of the wire insertion groove and configured to restrict movement of the drive wire in the direction of detachment from the wire insertion groove.

A third window regulator is the second window regulator in which a pair of the drive wires and a pair of the wire insertion grooves are provided to separately extend after having crossed each other at a crossing portion and the second wire retaining portion extends above the pair of drive wires crossing each other at the crossing portion.

A fourth window regulator is any one of the first to third window regulators in which the carrier piece has an insertion hole for inserting a fastening member configured to fasten the carrier piece into a glass holder holding the window glass, and the fastening member is positioned above the drive wire in a state in which the fastening member is inserted into the insertion hole.

A fifth window regulator is any one of the first to fourth window regulators in which a through-hole facing the first wire retaining portion is provided at the wire insertion groove and the first wire retaining portion is inclined from a side portion of the wire insertion groove toward above the through-hole.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A window regulator comprising:

a carrier piece attached to a window glass;

drive wires connected to the carrier piece and configured to lift and lower the carrier piece; and a wire end connected to an end portion of one of the drive wires, wherein the carrier piece has a wire end housing portion configured to house the wire end, a wire insertion groove communicating with the wire end housing portion, wherein the one of the drive wires is disposed in the wire insertion groove and an upper side of the wire insertion groove includes an opening which opens in a direction crossing a routing direction of the one of the drive wires, a through-hole which intersects with the wire insertion groove, and a first wire retaining portion extending so as to at least partially close the opening at the upper side of the wire insertion groove, and restricting detachment of the one of the drive wires from the wire insertion groove by preventing movement of the one of the drive wires in the direction crossing the routing direction by contacting the one of the drive wires, the first wire retaining portion comprises a locking claw portion, the locking claw portion includes a base end and a tip end, the tip end includes a lower surface which contacts the one of the drive wires to restrict said detachment of the one of the drive wires, and the through-hole faces the lower surface of the locking claw portion.

2. The window regulator according to claim 1, wherein the carrier piece has a second wire retaining portion, the second wire retaining portion is configured to restrict detachment of a second one of the drive wires from a second wire insertion groove, and is provided apart from the first wire retaining portion.

3. The window regulator according to claim 2, wherein the extend drive wires separately extend after having crossed each other at a crossing point, the wire insertion grooves separately extend after having crossed each other at the crossing point, and the second wire retaining portion extends above the drive wires crossing each other at the crossing point.

4. The window regulator according to claim 3, wherein the carrier piece has an insertion hole for receiving a fastening member configured to fasten the carrier piece to a glass holder holding the window glass, and the drive wires and the fastening member are positioned so as to overlap with each other when the fastening member is inserted into the insertion hole.

5. The window regulator according to claim 2, wherein the carrier piece has an insertion hole for receiving a fastening member configured to fasten the carrier piece to a glass holder holding the window glass, and the drive wires and the fastening member are positioned so as to overlap with each other when the fastening member is inserted into the insertion hole.

6. The window regulator according to claim 1, wherein the carrier piece has an insertion hole for receiving a fastening member configured to fasten the carrier piece to a glass holder holding the window glass, and the drive wires and the fastening member are positioned so as to overlap with each other when the fastening member is inserted into the insertion hole.

* * * * *